US009196218B2

(12) United States Patent
Kim et al.

(10) Patent No.: US 9,196,218 B2
(45) Date of Patent: Nov. 24, 2015

(54) DISPLAY DEVICE HAVING DRIVING CONTROL CIRCUIT OPERATING AS MASTER OR SLAVE

(71) Applicant: SILICON WORKS CO., LTD, Daejeon-si (KR)

(72) Inventors: Young-Gi Kim, Daejeon-si (KR); Hye-Lan Kim, Asan-si (KR); Na-Ra Hong, Daejeon-si (KR); Joon-Ho Na, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 38 days.

(21) Appl. No.: 14/190,075

(22) Filed: Feb. 25, 2014

(65) Prior Publication Data

US 2014/0300654 A1 Oct. 9, 2014

Related U.S. Application Data

(63) Continuation-in-part of application No. 13/335,224, filed on Dec. 22, 2011, now Pat. No. 8,698,857.

(30) Foreign Application Priority Data

Dec. 27, 2010 (KR) ..... 10-2010-0135720

(51) Int. Cl.
*G09G 5/10* (2006.01)
*G09G 5/00* (2006.01)

(52) U.S. Cl.
CPC ..... *G09G 5/008* (2013.01)

(58) Field of Classification Search
USPC ..... 345/691
See application file for complete search history.

(56) References Cited

U.S. PATENT DOCUMENTS

| | | | | |
|---|---|---|---|---|
| 2006/0232579 | A1* | 10/2006 | Chen et al. | 345/211 |
| 2008/0055341 | A1* | 3/2008 | Morita et al. | 345/690 |
| 2008/0143660 | A1* | 6/2008 | Itou | 345/87 |
| 2009/0213056 | A1* | 8/2009 | Nam et al. | 345/90 |
| 2010/0085368 | A1* | 4/2010 | Shin et al. | 345/534 |

FOREIGN PATENT DOCUMENTS

KR 10-2007-0069408 7/2007

* cited by examiner

*Primary Examiner* — Long D Pham
(74) *Attorney, Agent, or Firm* — Kile Park Reed & Houtteman PLLC

(57) ABSTRACT

The present invention aims to provide a driving control circuit of a display device, which includes a plurality of data driving circuits each having a timing controller merged with a source driver. The data driving circuits are configured to synchronize data of the respective data driving circuits and compensate for a difference between a data enable signal and a gate output enable signal, when an abnormal display signal is received.

20 Claims, 10 Drawing Sheets

Fig. 7

| nsb_goe[1] | nsb_goe[0] | TGOE (CLK) |
|---|---|---|
| 0 | 0 | -40 |
| 0 | 1 | 0 (default) |
| 1 | 0 | +40 |
| 1 | 1 | +80 |

Fig. 10

| nsb_hbp[1] | nsb_hbp[0] | THBP (CLK) |
|---|---|---|
| 0 | 0 | N – 25 |
| 0 | 1 | N (default) |
| 1 | 0 | N + 25 |
| 1 | 1 | N + 50 |

DISPLAY DEVICE HAVING DRIVING CONTROL CIRCUIT OPERATING AS MASTER OR SLAVE

CROSS REFERENCE TO RELATED APPLICATIONS

This application is a continuation-in-part application of U.S. patent application Ser. No. 13/335,224, filed Dec. 22, 2011 (now pending), the disclosure of which is herein incorporated by reference in its entirety. The U.S. patent application Ser. No. 13/335,224 claims priority to Korean Application No. 10-2010-0135720 filed on Dec. 27, 2010, the entire contents of which are incorporated herein by reference.

BACKGROUND OF THE INVENTION

1. Field of the Invention

The present invention relates to a technology for driving a display device, and more particularly, to a driving control circuit of a display device that is capable of displaying data generated therein, when a data driving circuit having a timing controller merged with a source driver receives an abnormal display signal.

2. Description of the Related Art

In recent years, flat-panel display devices, such as a liquid crystal display (LCD), a plasma display panel (PDP), an organic light emitting diode (OLED) panel and the like, have been widely used. Among such devices, liquid crystal displays are continually proliferating.

As a typical example of a flat panel display device, the liquid crystal display is configured to include a display panel (or a liquid crystal panel), in which a plurality of gate lines and a plurality of data lines are arranged in directions perpendicular to each other to create a pixel area having a matrix form; a driving circuit portion, for supplying driving signals and data to the display panel; and a backlight, for providing light to the display panel.

FIG. 1 shows a block diagram of a display device that includes a display panel and a driving circuit portion according to the related art. As shown in FIG. 1, the display device is configured to include a display panel 110, a timing controller 120, a plurality of source drivers 130A to 130C, and a gate driver 140.

Referring to FIG. 1, the display panel 110 includes a plurality of pixels arranged at intersections of the plurality of gate lines and the plurality of data lines in a matrix form. Each of the pixels includes a transistor and a display device, and the transistor transfers data inputted from the data line to the display device in response to a scan signal supplied from the corresponding gate line.

The timing controller 120 generates a gate control signal for controlling the gate driver 140 and data control signals for controlling the source drivers 130A to 130C by using vertical and horizontal sync signals and a clock signal supplied from a system. In addition, the timing controller 120 rearranges digital video data RGB (hereinafter, referred to as 'data') inputted from the system, and supplies the rearranged data to the source drivers 130A to 130C.

The source drivers 130A to 130C convert the data into a signal corresponding to a gray scale value and supply the signal to data lines of the display panel 110, in response to the data control signal supplied from the timing controller 120.

The gate driver 140 supplies a scan signal to the gate line in response to the gate control signal supplied from the timing controller 120, and drives horizontal lines of the display panel 110 to which the data are supplied.

In response to a state in which an abnormal display signal is inputted, the timing controller 120 provides data (mainly, black data) generated from an oscillator therein to the source drivers 130A to 130C. The state in which an abnormal display signal is inputted includes a first state in which power is supplied and a signal is not inputted or a second state in which a signal deviating from a normal operational range is inputted even though power is applied and a signal is inputted. The first state may include a state in which power is applied but a horizontal synchronization signal, a vertical synchronization signal, a data enable signal or a data clock is not inputted, and the second state may include a state in which a signal is inputted at a frequency of less than 20 Hz or more than 100 Hz, which deviates from a permissible range, when supposing that the frequency of a vertical synchronization signal for normal display is 60 Hz.

Even when an abnormal display signal is inputted, the timing controller 120 provides data for expressing a black screen to the source drivers 130A to 130C.

In recent years, in order to meet the needs of larger and thinner display devices, a product in which a timing controller is merged with a source driver has been developed. Hereafter, a source driver merged with a timing controller will be referred to as 'TMIC'.

Thus, the TMIC includes an oscillator and performs a timing control function and a source driving function. Accordingly, when a plurality of TMICs is used for driving the display panel, deviation may occur between the frequencies generated from the oscillators included in the respective TMICs. Thus, data outputted from the respective TMICs may not be synchronized with each other. This is because each of the TMICs outputs data using the horizontal synchronization signal, the vertical synchronization signal, and the data enable signal, which are generated through the clock signal having a frequency deviation.

In addition, due to the frequency deviation between the clock signals generated through the oscillators of the respective TMICs, an enable interval of the data enable signal generated from the TMIC with the oscillator, which generates the clock signal having the slowest frequency, may become longer than one horizontal interval of the horizontal synchronization signal generated from the TMIC with the oscillator which generates the clock signal having the fastest frequency.

Further, due to the frequency deviation between the clock signals generated through the oscillators of the respective TMICs, the last data latch enable signal of each TMIC may precede a gate output enable signal of the gate driver. The above-described problem occurs due to the frequency deviation between the respective TMICs.

Accordingly, the display device of the related art has various problems in that data are not synchronized with each other due to the frequency deviation between the clock signals generated through the oscillators of the respective TMICs, and thus has difficulties in displaying a natural black screen on a display panel when an abnormal display signal is inputted.

SUMMARY OF THE INVENTION

Accordingly, the present invention has been made in an effort to solve the problems occurring in the related art, and an object of the present invention is to naturally display a black screen on a display panel in response to the case in which an abnormal display signal is inputted, in a display device including a plurality of TMICs each having a source driver merged with a timing controller.

Another object of the present invention is to prevent a malfunction in which data of a plurality of TMICs are not synchronized with each other, due to a frequency deviation between clock signals generated through oscillators, when a display panel is driven through the plurality of TMICs each having a source driver merged with a timing controller.

Another object of the present invention is to display data of TMICs, which are not synchronized with each other due to a frequency deviation between clock signals generated from oscillators, on a display panel by improving a gate output enable signal of a gate driver.

In order to achieve the above object, according to one aspect of the present invention, there is provided a driving control circuit of a display device comprising a plurality of data driving circuits. Each of the data driving circuits may include: an oscillator configured to provide a clock signal; a source driver IC configured to recover at least first data and a data enable signal in response to a normal display signal, generate second data using the clock signal according to a determination result corresponding to an input state of an abnormal display signal, and provide any one of the first and second data to a display panel; an input signal detection unit configured to provide the determination result using the clock signal; and a timing controller having a setting value corresponding to any one of a master and a slave, and configured to provide the data enable signal to another data driving circuit set to the slave in response to the determination result when set to the master, provide the data enable signal, of which an end time of a horizontal blank interval is matched with an external data enable signal, to the source driver IC when set to the slave, and provide a gate output enable signal having a corrected pulse width such that a data output signal maintains an enable state in response to a driving interval of the gate line.

BRIEF DESCRIPTION OF THE DRAWINGS

The above objects, and other features and advantages of the present invention will become more apparent after a reading of the following detailed description taken in conjunction with the drawings, in which:

FIG. 7 is a table showing an example in which the generation time point of a gate output enable signal is adjusted;

FIG. 10 is a table indicating an example in which a data enable signal of the TMIC is adjusted.

DETAILED DESCRIPTION OF PREFERRED EMBODIMENTS

Figure 1:
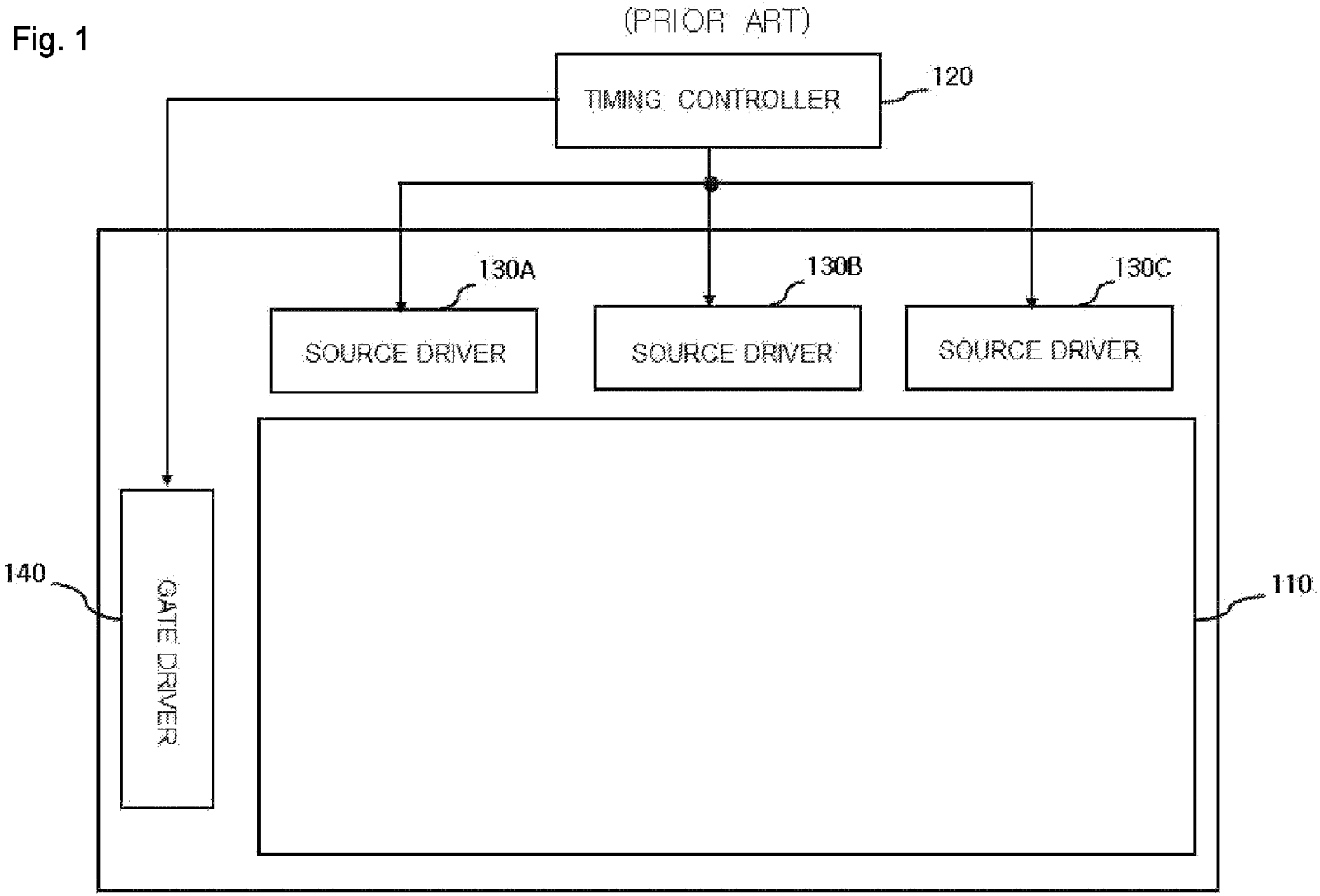
FIG. 1 is a block diagram of a display device according to the related art.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
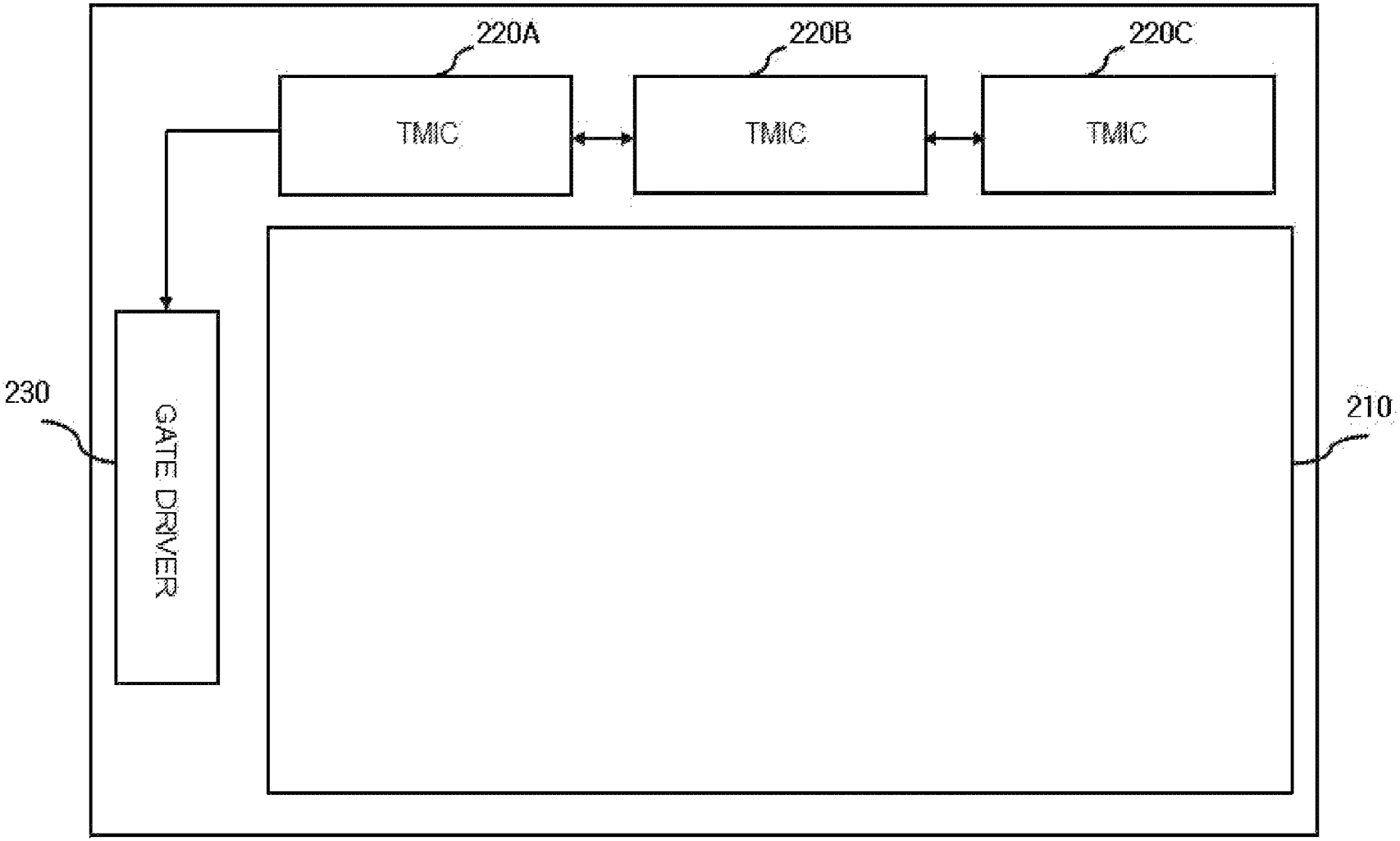
FIG. 2 is a block diagram of a driving control circuit of a display device according to an embodiment of the present invention.

FIG. 2 shows a block diagram of a driving control circuit of a display device in accordance with the present invention. As shown in FIG. 2, the driving control circuit includes a display panel 210, a plurality of TMICs 220A to 220C, and a gate driver 230.

Referring to FIG. 2, the display panel 210 includes a plurality of pixels formed at the respective intersections between a plurality of gate lines and a plurality of data lines in a matrix form. Each of the pixels includes a transistor and a display device. The transistor transfers data inputted from the corresponding data line to the display device in response to a scan signal supplied from the corresponding gate line.

Each of the TMICs 220A to 220C has a structure in which one timing controller is merged with one source driver IC. In this case, each of the timing controllers generates necessary data and various control signals by using an oscillation signal generated from a separate oscillator. That is, the TMIC may be defined as a data driving circuit having a structure in which a timing controller is merged with a source driver.

Here, the case in which the TMIC 220A uses a 44 MHz oscillator, the TMIC 220*b* uses a 40 MHz oscillator, and the TMIC 220C uses a 36 MHz oscillator will be taken as an example for description.

In such a case, any one of the TMICs 220A to 220C can operate as a master, and the other TMICs can operate as slaves. Herein, the case in which the TMIC 220A operates as the master and the other TMICs 220B and 220C operate as the slaves will be taken as an example for description.

As described above, the TMICs 220A to 220C use clock signals having different frequencies. Thus, a horizontal synchronization signal HSYNC and a data enable signal DE, which are generated through the clock signals inside the respective TMICs 220A to 220C, may have different cycles. Accordingly, the data of the TMICs 220A to 220C are outputted at slightly different timings.

In the embodiment of the present invention, the data enable signal DE of the TMIC 220A is provided to the TMICs 220B and 220C so as to match rising edges of the data enable signals DE of the TMICs 220B and 220C with rising edges of the data enable signal DE of the TMIC 220A. That is, end times of horizontal blank intervals of the TMICs 220B and 220C are matched on the basis of the TMIC 220A.

Figure 3:
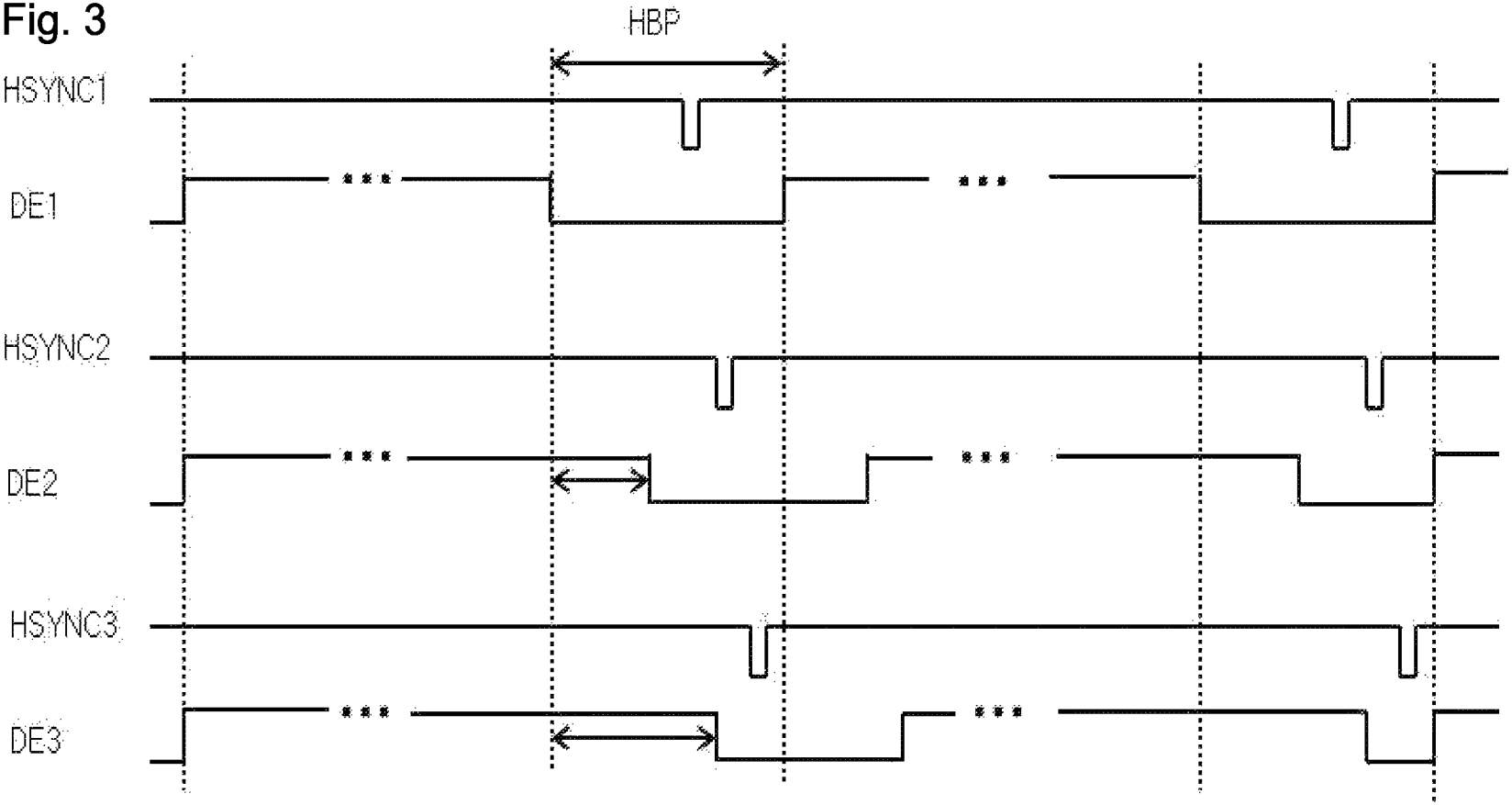
FIG. 3 is a waveform view of a horizontal synchronization signal and a data enable signal for each of TMICs of FIG. 2.

In FIG. 3, a horizontal synchronization signal HSYNC1 and a data enable signal DE1 are generated from the TMIC 220A, a horizontal synchronization signal HSYNC2 and a data enable signal DE2 are generated from the TMIC 220B, and a horizontal synchronization signal HSYNC3 and a data enable signal DE3 are generated from the TMIC 220C. Here, 'HBP' indicates a horizontal blank interval. As described with reference to FIG. 3, the horizontal blank interval HBP may be adjusted to solve a problem in which the enable interval of the data enable signal DE3 generated from the oscillator that generates the clock signal having the slowest frequency is longer than one cycle of the horizontal synchronization signal HSYNC1 generated from the oscillator that generates the clock signal having the fastest frequency.

As shown in FIG. 3, cycles of the data enable signals DE1 to DE3 are equivalent to cycles of the horizontal synchronization signals HSYNC1 to HSYNC 3. As the TMICs 220A to 220C use clock signals having different frequencies, the cycle of the horizontal synchronization signal HSYNC2 is longer than the cycle of the horizontal synchronization signal HSYNC1 and the cycle of the horizontal synchronization signal HSYNC3 is longer than the cycle of the horizontal synchronization signal HSYNC2. Accordingly, after first cycles (first vertical lines) of the data enable signals DE2 and DE3, end times of the horizontal blank intervals of the data enable signals DE2 and DE3 appear slightly later than the end time of the horizontal blank interval of the data enable signal DE1.

For reference, 'high' intervals of the data enable signals DE1 to DE3 are preparation intervals in which the TMICs 220A to 220C are arranged to load data into the data line of the display panel 210, and the 'low' intervals of the data enable signals DE1 to DE3, which correspond to the horizontal blank intervals, are intervals for loading data into the data line.

The TMICs 220B and 220C detect the end time of the horizontal blank interval of the data enable signal DE1 received from the TMIC 220A, using the clock signals of the oscillators embedded therein, and match the end times of the horizontal intervals of the date enable signals DE2 and DE3.

FIG. 3 shows results in which the end times of the horizontal intervals of the date enable signals DE1 to DE3 are matched through the above-described adjustment.

The gate driver IC 230 sequentially supplies a scan signal to the gate line in response to the gate output enable signal supplied from any one timing controller of the TMICs 220A to 220C, for example, the timing controller of the TMIC 220A.

However, a gate output enable signal GOE of the timing controller of the TMIC 220A is generated by using an oscillation signal having a different frequency from those used in the timing controllers of the other TMICs 220B and 220C. Thus, due to the synchronization mismatch among the TMICs 220A to 220C, the last data latch enable signals LOAD of the TMICs 220A to 220C may be generated prior to the time point at which the gate output enable signal GOE transits from the 'low' level to the 'high' level.

In order to solve this problem, the timing controller of the TIMC 220A according to the embodiment of the present invention adjusts and outputs the gate output enable signal GOE such that a rising edge appears before the data latch enable signal LOAD having the highest frequency among the TMICs 220A to 220C is supplied. The signal processing process according to the embodiment of the present invention will be described with reference to FIGS. 4 to 7.

For reference, a 'low' interval of the gate output enable signal GOE is an interval in which the gate line of the display panel 210 is driven to transmit data of the data line to a pixel, and a 'high' interval is an interval in which the gate line is not driven.

Figure 4:
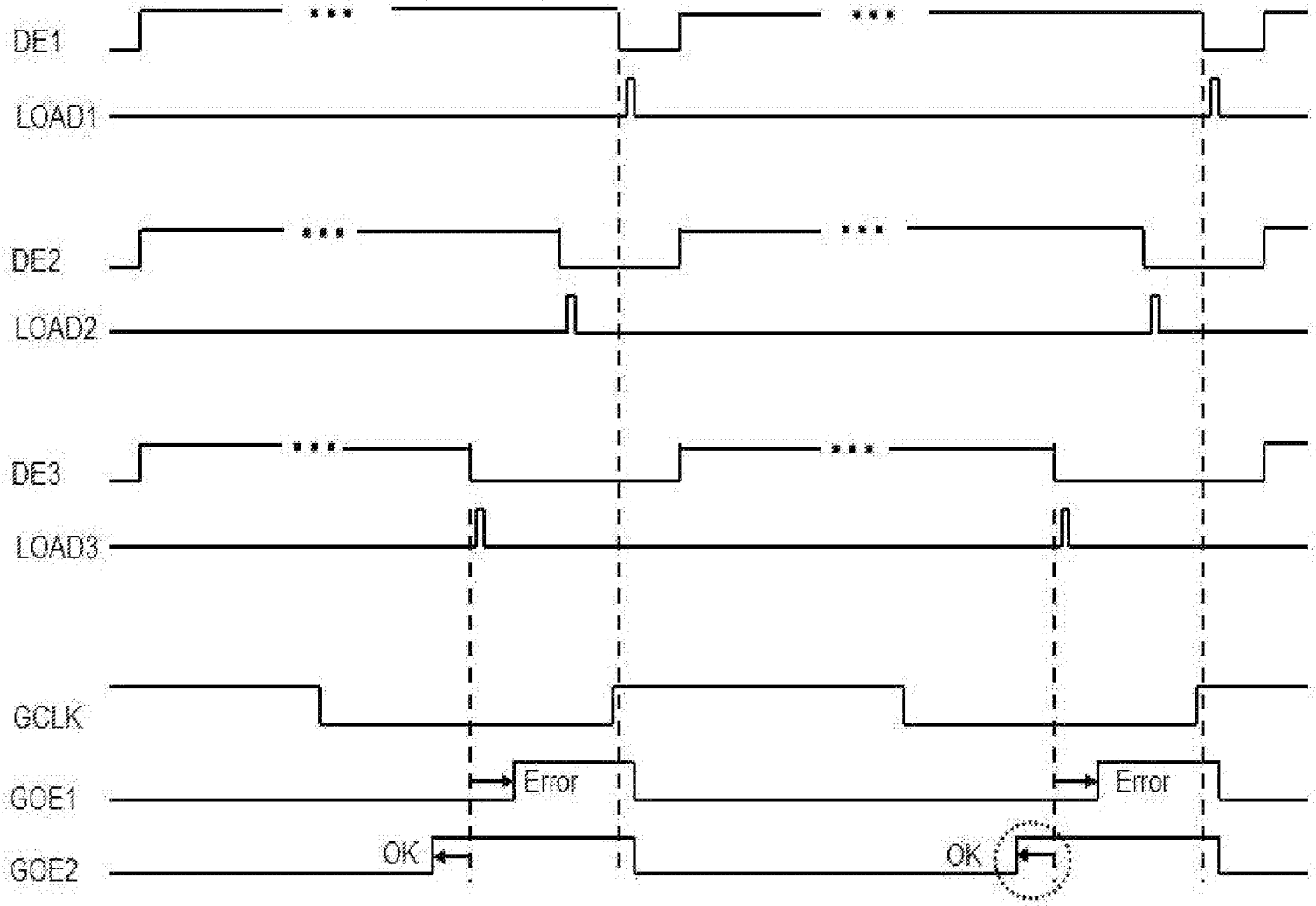
FIG. 4 is a waveform view of a data enable signal, a data latch enable signal, a gate clock signal and a gate output enable signal for each of the TMICs of FIG. 2.

In FIG. 4, the data enable signal DE1 and the data latch enable signal LOAD1 are generated in the TMIC 220A, and the TMIC 220A uses an oscillator for generating a clock signal at a frequency of 36 MHz, for example. The data enable signal DE2 and the data latch enable signal LOAD2 are generated in the TMIC 220B, and the TMIC 220B uses an oscillator for generating a clock signal at a frequency of 40 MHz, for example. The data enable signal DE3 and the data latch enable signal LOAD3 are generated in the TMIC 220C, and the TMIC 220C uses an oscillator for generating a clock signal at a frequency of 44 MHz oscillator, for example.

In such a case, it can be seen that the data enable signals DE3 to DE1 transit from the 'high' level to the 'low' level in descending order of frequency, and the data latch enable signals LOAD3 to LOAD1 are generated in descending order of frequency in synchronization with the transitions.

The gate output enable signal GOE1 supplied to the gate driver 230 by the TMIC 220A is generated using a clock signal having a different frequency from those of the other TMICs 220B and 220C. Thus, the latch enable signals LOAD3 having the highest frequency may be already generated before the gate output enable signal GOE1 transits from the 'low' level to the 'high' level. In this case, before the data of the previous horizontal line are fully loaded, the data of the current horizontal line may also be loaded to overlap the data of the previous horizontal line. As a result, the data of the previous horizontal line may be lost. In FIG. 4, GCLK represents a gate clock signal.

In order to prevent this problem, the gate output enable signal is corrected according to the embodiment, and the corrected gate output enable signal is represented as 'GOE2'. That is, the timing controller of the TMIC 220A adjusts the rising edge of the gate output enable signal GOE2 to slightly precede the data latch enable signal LOAD3 having the highest frequency, and then outputs the adjusted signal to the gate driver 230. Even though the output enable signals GOE1 and GOE2 are the same signal GOE, the signals are expressed with different numbers to distinguish between before and after correction.

Of course, when the gate output enable signal GOE is corrected into the gate output enable signal GOE2, the 'low' interval is lost by the extended 'high' interval of the gate output enable signal GOE, but the degradation in quality of the black screen due to the lost interval is negligible. The state in which the gate output enable signal GOE is at the 'high' level may be defined as the enable state.

Figure 5:
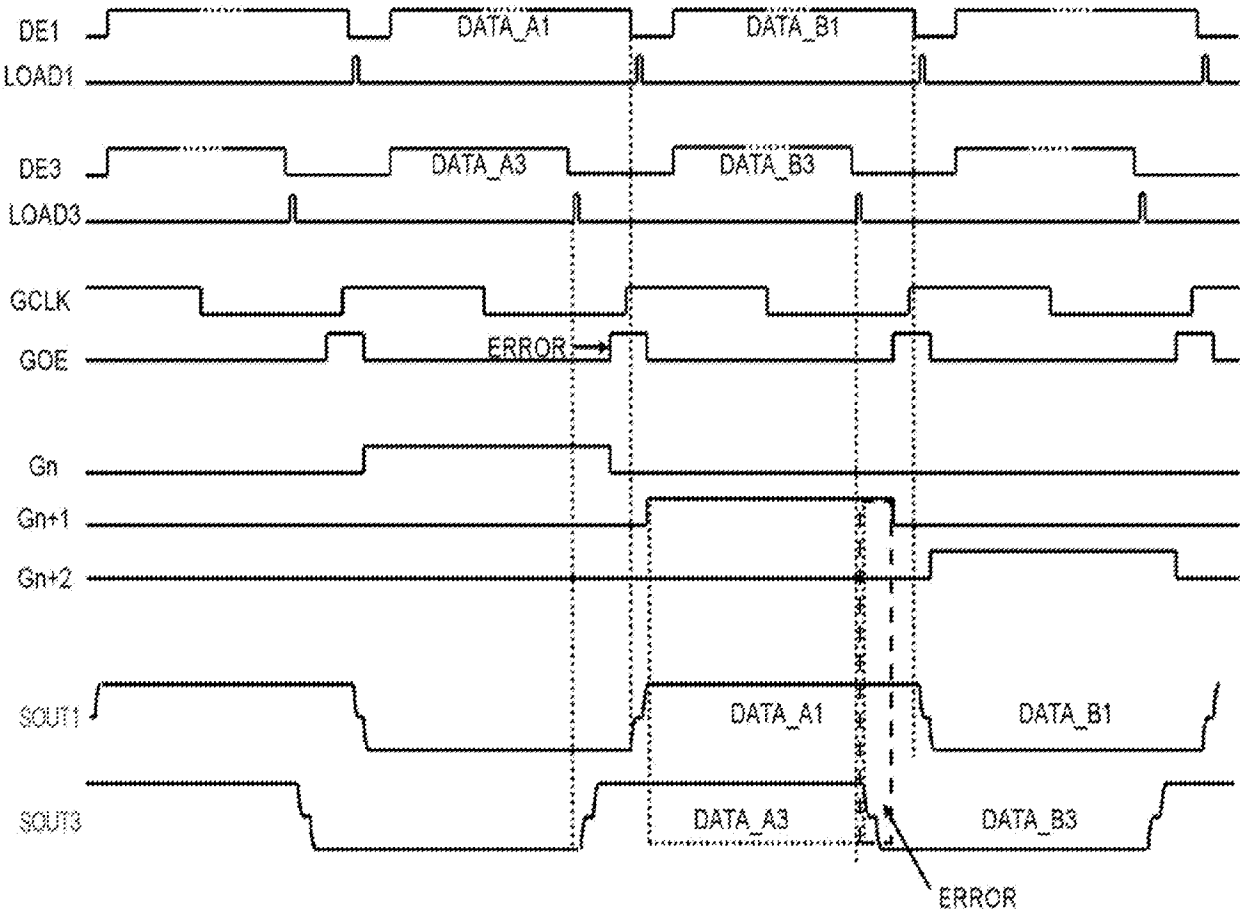
FIG. 5 is a waveform view for explaining that an error interval is generated by synchronization mismatch between a data latch enable signal and a gate output enable signal.

FIG. 5 is a waveform view showing that an error interval occurs because the gate output enable signal GOE is at the 'low' level before the last data latch enable signal LOAD of each of the TMICs 220A to 220C is supplied, as described above.

Referring to FIG. 5, it can be seen that the data latch enable signal LOAD3 is already generated by the TMIC 220C including the oscillator that generates the clock signal having the highest frequency before the gate output enable signal GOE transits from the 'low' level to the 'high' level. Accordingly, the output SOUT1 of the TMIC 220A can be continually maintained at the 'high' level in the driving interval of the gate line Gn+1, but the output SOUT3 of the TMIC 220C causes an error interval ERROR which is maintained at the 'low' level at the end portion of the gate line Gn+1.

Figure 6:
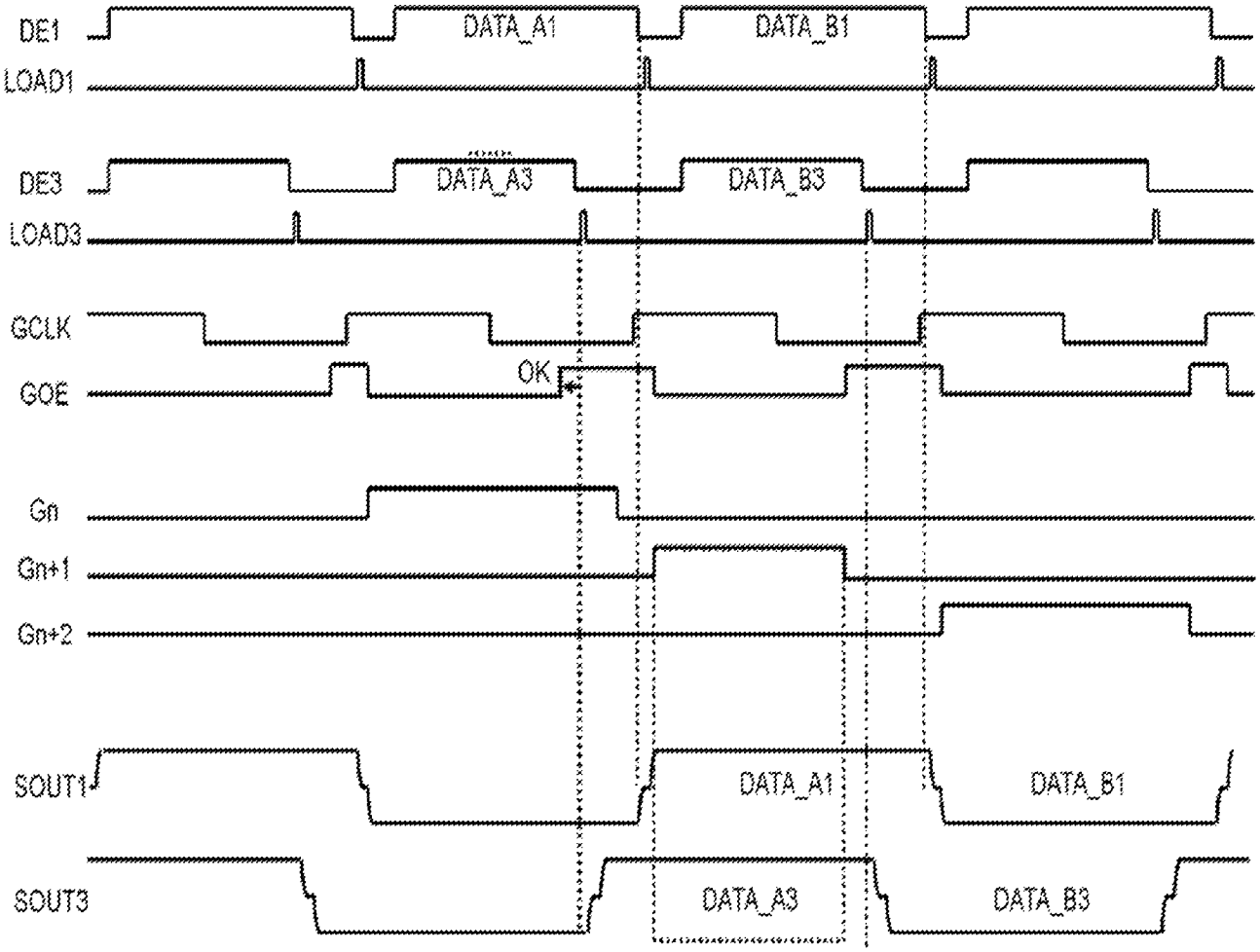
FIG. 6 is a waveform view for explaining that a data latch enable signal and a gate output enable signal are adjusted to be synchronized with each other.

FIG. 6 is a waveform view indicating that the gate output enable signal GOE is corrected to transit from a 'low' level to a 'high' level before the last data latch enable signal LOAD of each of the TMICs 220A to 220C is supplied. As the gate output enable signal GOE is corrected, an error interval does not occur.

Referring to FIG. 6, as described above, the rising edge of the gate output enable signal GOE is corrected to be extended in the previous time direction, and a driving interval of a gate line Gn+1 is reduced by the corrected width of the rising edge of the gate output enable signal GOE. Accordingly, since the output SOUT3 of the TMIC 220C as well as the output SOUT1 of the TMIC 220A is maintained at the 'high' level in response to the driving interval of the gate line Gn+1, the above-described error interval ERROR does not occur.

When an abnormal display signal is inputted, the system for displaying the display device using a plurality of TMICs is designed such that a rising edge of the gate output enable signal GOE is generated earlier than during normal operation. Nevertheless, if the frequency deviation between the oscillators of the respective TMICs used in the display device is greater than expected, the gate output enable signal GOE needs to be adjusted so that the rising edge of the gate output enable signal GOE is generated earlier than the original generation time point. In contrast, if the frequency deviation between the oscillators of the respective TMICs used in the display device is less than expected, no problems may occur even though the rising edge of the gate output enable signal GOE is later than the original generation time point. In this case, the rising edge of the gate output enable signal GOE may be generated later than the original generation time point so as to secure a pixel-charging time.

There may be several methods of adjusting the generation time point of the rising edge of the gate output enable signal GOE, when an abnormal display signal is inputted.

As a first example, the TMIC 220A, operating as a master, can adjust the generation time point of the gate output enable signal GOE by varying a register value, which is separately provided using an inter-integrated circuit 12C or a serial peripheral interface SPI.

As a second example, the generation time point of the rising edge of the gate output enable signal GOE can be adjusted by varying an input value of a separate input option pin assigned in an integrated circuit.

The two embodiments will be described in detail with reference to FIG. 7. The name of a separate register or option pin for adjusting the generation time point of the rising edge of the gate output enable signal GOE when an abnormal display signal is inputted may be represented by nsb_goe. When 2 bits are assigned to nsb_goe, the generation time point of the gate output enable signal GOE can be adjusted according to the bit values. In this case, nsb_goe[1] indicates an upper bit, and nsb_goe[2] indicates a lower bit.

That is, when nsb_goe is '01', the generation time point of the rising edge of the gate output enable signal GOE is set to "0", as a default value. When nsb_goe is '00', the generation time point of the rising edge of the gate output enable signal GOE is set to "−40× oscillator's clock frequency CLK". When nsb_goe is '10', the generation time point of the rising edge of the gate output enable signal GOE is set to "+40× oscillator's clock frequency CLK". When nsb_goe is '11', the generation time point of the rising edge of the gate output enable signal GOE is set to "+80× oscillator's clock frequency CLK". The 2 bits are assigned to the register or option pin as the number of bits, but the number of bits can be set to 3 or more bits, if necessary. In addition, "−40", "+40" and "+80" are exemplary numbers, and the numbers may be set to be suitable for the system depending on the design.

Figure 8:
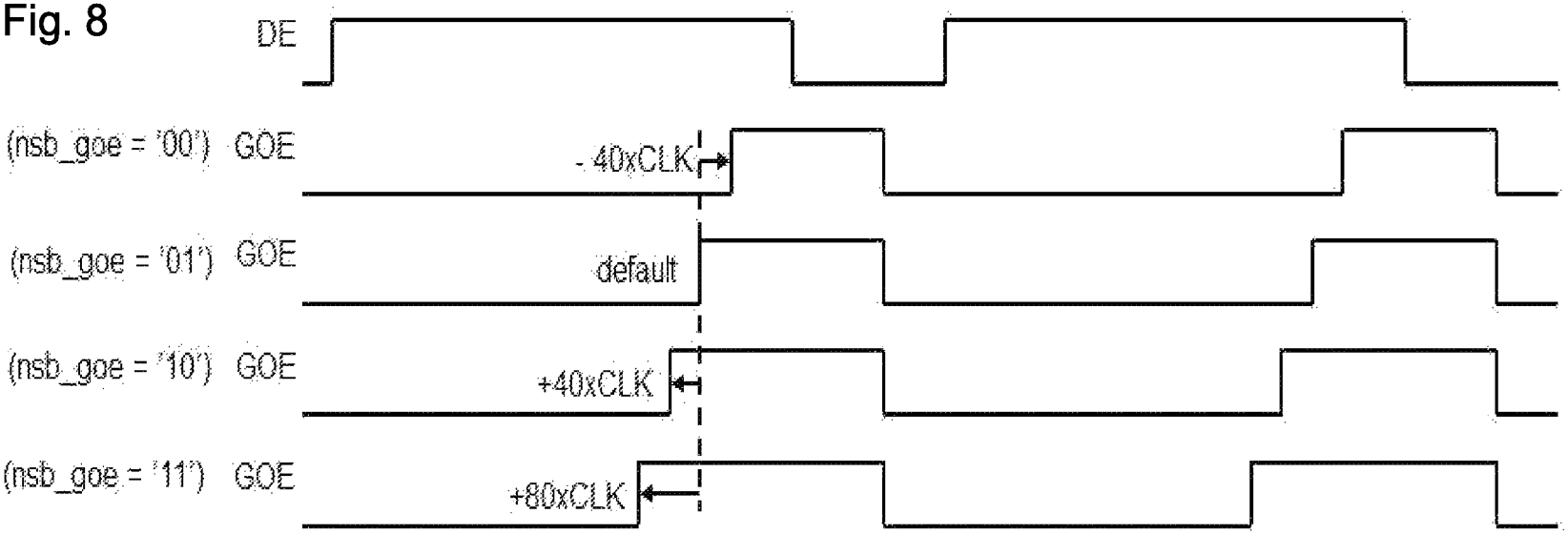
FIG. 8 is a waveform view indicating an example in which the generation time point of a gate output enable signal is adjusted.

FIG. 8 is a waveform view indicating an example in which the generation time point of the gate output enable signal is adjusted according to the compensation operation as shown in FIG. 7.

Figure 9:
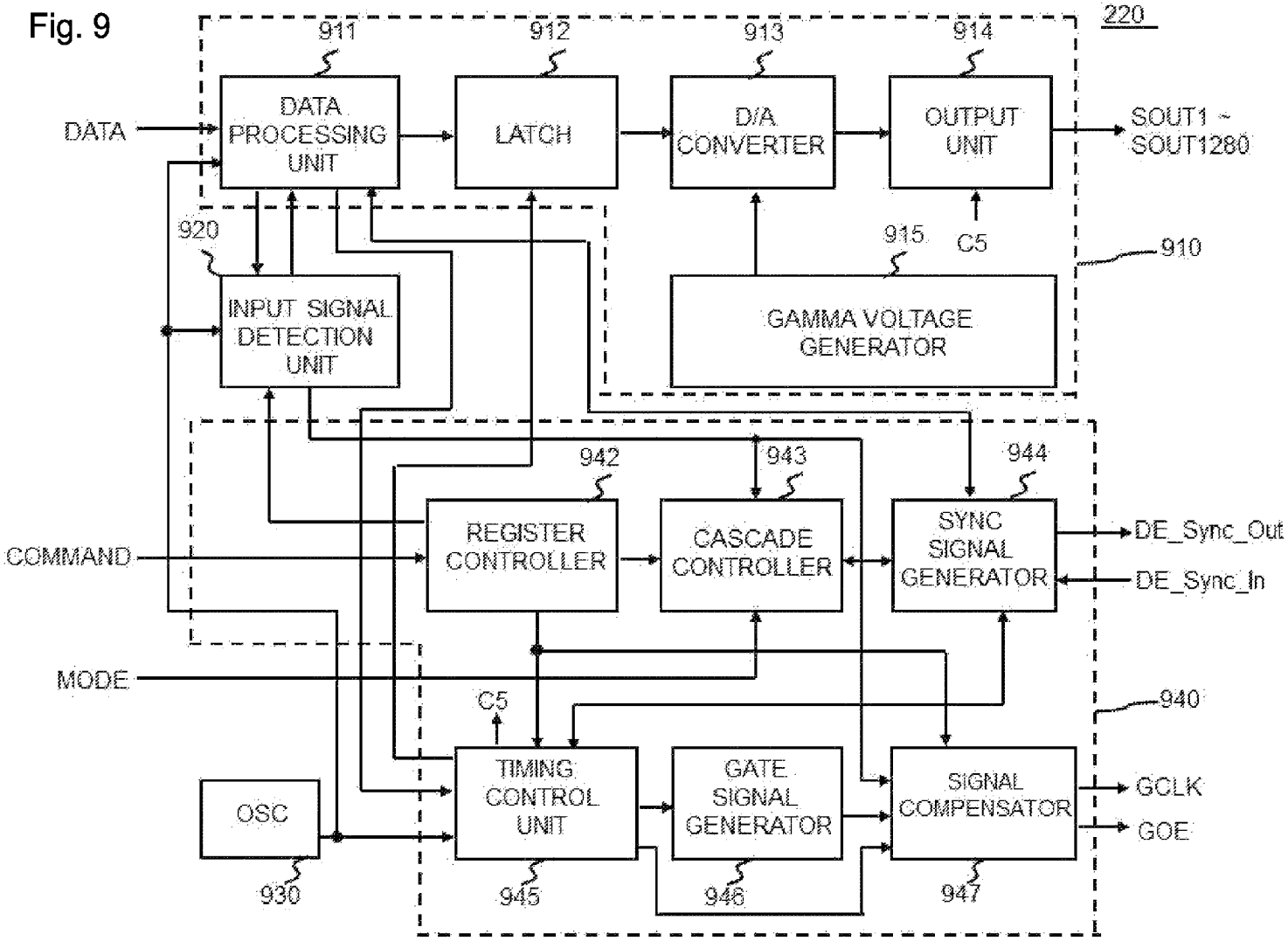
FIG. 9 is a detail block diagram of the TMIC of FIG. 2.

FIG. 9 is a detail block diagram of the TMICs 220A to 220C according to the embodiment of the present invention. As shown in FIG. 9, each TMIC includes a source driver 910, an input signal detection unit 920, an oscillator 930 and a timing controller 940.

The source driver 910 includes a data processing unit 911, a latch 912, a digital to analog (D/A) converter 913, an output unit 914 and a gamma voltage generating unit 915.

The timing controller 940 includes a register control unit 942, a cascade controller 943, a synchronization signal generating unit 944, a timing control unit 945, a gate signal generating unit 946 and a signal compensation unit 947.

Referring to FIG. 9, the oscillator 930 is configured to provide a clock signal to the data processing unit 911, the input signal detection unit 920, and the timing control unit 945.

When a display signal is inputted from outside in a normal state, the data processing unit 911 recovers data, a clock signal, a data enable signal DE, a horizontal synchronization signal Hsync and a vertical synchronization signal Vsync, transmits the recovered data to the latch 912, and provides the clock signal, the data enable signal DE, the horizontal synchronization signal Hsync and the vertical synchronization signal Vsync to the timing control unit 945. Then, the data processing unit 911 provides the data, the clock signal, the data enable signal DE, the horizontal synchronization signal Hsync and the vertical synchronization signal Vsync to the input signal detection unit 920.

The input signal detection unit 920 determines whether the data, the clock signal, the data enable signal DE, the horizontal synchronization signal Hsync and the vertical synchronization signal Vsync of the data processing unit 911 are in a normal state, by referring to the clock signal provided from the oscillator 930. When it is determined that an abnormal display signal was inputted, the input signal detection unit 920 a frame frequency and a data type (black or RGB value) for generating data for display to the data processing unit 911, using setting information provided from the register control unit 942.

When an abnormal display signal is inputted, the data processing unit 911 generates data corresponding to the frame frequency and the data type provided from the input signal detection unit 920, using the clock signal of the oscillator 930, and provides the generated data to the latch 912.

The latch 912 temporarily stores data supplied from the data processing unit 911 and outputs the data to the D/A converter 913. For the operation of the latch 912, the timing control unit 945 provides a data latch enable signal, and the data latch enable signal may include a shift clock signal and a load signal.

The D/A converter 913 selects and outputs gray scale voltage (gray voltage) corresponding to data inputted from the latch 912, among gray scale voltage of a predetermined step generated from the gamma generating unit 915.

The output unit 914 buffer and amplifies data of each channel which is applied from the D/A converter 913 and outputs the amplified data to the data line of the display panel. For the operation of the output unit 914, the timing control unit 945 may provide an output enable signal. According to the output enable signal, output signals SOUT1 to 51280 may be outputted to the data line of the display panel at the same time. In FIG. 9, the output enable signal may correspond to 'C5'.

The input signal detection unit 920 provides a determination result, corresponding to the case in which a normal or abnormal display signal is inputted, to the cascade controller 943 and the signal compensation unit 947.

The register control unit 942 controls the cascade controller 943, the timing control unit 945 and the signal compensation unit 947 in response to the command signal COMMAND inputted from outside. The command signal COMMAND may include deviation information for controlling the timing of the signal. The deviation information is information related to the frequency deviation between the clock signals of the oscillators of the respective TMICs 220A to 220C. In such a case, the register control unit 942 writes the deviation information into the internal register and controls the cascade controller 943, the timing control unit 945 and the signal compensation unit 947 based on the deviation information.

The cascade controller 943 determines whether to operate any TMIC 220 of the TMICs 220A to 220C as a master or slave by using mode determination information MODE provided as a register value or pin option signal, and provides the mode determination information to the synchronization generating unit 944. At this time, the cascade controller 943 may provide the mode determination information to the timing control unit 945.

There may be several methods in which the mode determination information is stored (set) in the internal register of the cascade controller 943. When an abnormal display signal is first received in the TMICs 220A to 220C, the mode signal or the internal resister can be set to operate as the master.

When the cascade controller 943 controls the corresponding TMIC to operate as the master, the synchronization signal generating unit 944 operates in a different manner from the case in which the cascade controller 943 controls the corresponding TMIC to operate as a slave. First, when the cascade controller 943 controls the TMIC to operate as the master, the synchronization signal generating unit 944 transmits the data enable signal DE provided from the timing control unit 945 to another TMIC through a synchronization signal output terminal DE_Sync_Out. At this time, the timing control unit 945 defines and processes enable and disable intervals for the data enable signal DE generated through the data processing unit 911, and provides the processed data enable signal DE to the synchronization signal generating unit 944. On the other hand, when the cascade controller 943 controls the TMIC to operate as a slave, the synchronization generating unit 944 receives the data enable signal DE through a synchronization signal input terminal DE_Sync_In from outside, and transmits the received data enable signal DE to the data processing unit 911 and the timing controller 945. At this time, the data processing unit 911 and the timing controller 945 perform an operation by using the external data enable signal DE.

According to the embodiment of the present invention, since the data enable signal DE can be shared by the respective TMICs, synchronization may be performed. Thus, when the corresponding TMIC operates as the master in response to the case in which an abnormal display signal is inputted, the TMIC may generate data for display by using the determination result generated through the input signal detection unit 920, and when the TMIC operates as a slave, the TMIC may generate data for display by using the determination result generated through the master.

The timing control unit 945 generates the source control signal and the gate control signal by using the data enable signal DE.

When the corresponding TMIC operates as the master, the timing control unit 945 generates source control signals for a frame and one horizontal cycle by using the data enable signal DE provided from the data processing unit 911, and the source control signal may include a data latch enable signal or output enable signal and be provided to the latch 912 and the output unit 914.

When the corresponding TMIC operates as a slave, the timing control unit 945 generates source control signals for a frame and one horizontal cycle by using the data enable signal DE of the master, transmitted from the synchronization signal generating unit 944. At this time, the end time of the horizontal blank interval of the data enable signal DE may be synchronized with the data enable signal DE of the TMIC serving as the master, as illustrated in FIG. 3.

The gate control signal of the timing control unit 945 can be provided to the gate signal generating unit 946. The gate signal generating unit 946 generates a gate clock signal GCLK and a gate output enable signal GOE by referring to the gate control signal, and provides the generated signals to the signal compensation unit 947.

Furthermore, the timing control unit 945 may provide compensation information to the signal compensation unit 947. The compensation information may be used to correct image distortion caused by a difference in one horizontal cycle between the master and the slave, by referring to the value set in the register control unit 942.

The signal compensation unit 947 may recognize the input of the abnormal display signal according to the determination result of the input signal detection unit 920. In this case, the signal compensation unit 947 may compensate for the time point at which a rising edge of the gate output enable signal GOE is generated, by referring to the compensation information of the timing control unit 945. That is, in order to solve the problem caused by the frequency difference between the clock signals of the respective TMICs, the compensation for the generation time point of the rising edge of the gate output enable signal GOE may be performed as illustrated in FIGS. 4 to 8.

The operations of the TMICs 220A to 220C when an abnormal display signal is inputted as described above will be described in detail with reference to FIG. 3.

The TMIC 220A uses an oscillator for generating a 44 MHz clock signal, the TMIC 220B uses an oscillator for generating a 40 MHz clock signal, and the TMIC 220C uses an oscillator for generating a 36 MHz clock signal. In this case, suppose that the TMIC 220A serves as the master.

When the input signal detection unit 920 determines that an abnormal display signal is inputted, the source driver 910 of the TMIC 220A generates and outputs display data by using the clock signal of the oscillator 930 therein. At this time, the enable interval and the disable interval of the data enable signal DE provided from the data processing unit 911 are processed through the timing control unit 945, and then provided to the TMICs 220B and 220C set to slaves through the synchronization signal generating unit 944.

In the TMICs 220B and 220C, the synchronization signal generating unit 944 may transmit the data enable signal DE inputted from outside to the data processing unit 911 and the timing control unit 945. As illustrated in FIG. 3, the timing control unit 945 may synchronize the end time of the data enable signal DE of the data processing unit 911 with the data enable signal DE of the master by referring to the data enable signal DE inputted from outside. Thus, the source drivers 910 of the TMICs 220B and 220C may generate and output display data using the clock signals of the oscillators 930 therein, while synchronized with the master.

Meanwhile, there may be several methods for matching the end times of the horizontal blank intervals of the data enable signals DE generated from the TMICs 220A to 220C as described above.

As a first example, the timing processing unit 945 can adjust the horizontal blank interval HBP such that it is longer or shorter than the original horizontal blank interval by varying register values separately provided by using an inter-integrated circuit 12C or a serial peripheral interface SPI.

As a second example, the horizontal blank interval HBP can be adjusted such that it is longer or shorter than the original interval by varying an output value of a separate option pin assigned in an integrated circuit.

The two embodiments will be described in more detail with reference to FIG. 10. When an abnormal display signal is inputted, a separate register or option pin for adjusting the horizontal blank interval HBP during a non-signal operation is represented by nsb_hbp. In this case, if 2 bits are assigned to nsb_hbp, the horizontal blank interval HBP can be adjusted according to the bit value. That is, when nsb_hbp is '01', the horizontal blank interval HBP is set to "N× oscillator's clock frequency" as a default setting value. When nsb_hbp is '00', the horizontal blank interval HBP is set to "(N−25)× oscillator's clock frequency". When nsb_hbp is '10', the horizontal blank interval HBP is set to "(N+25)× oscillator's clock frequency". When nsb_hbp is '11', the horizontal blank interval HBP is set to "(N+50)× oscillator's clock frequency".

The number of bits assigned to the register or option pin is not fixed to 2 bits as described above, but the number of bits can be set to 3 or more bits, if necessary. In addition, "N" is not a fixed value and may be set to be suitable for the system, and "−25", "+25" and "+50" are exemplary numbers, and may be set to be suitable for the system depending on the design.

According to the embodiment of the present invention, the plurality of TMICs each having the source driver merged with the timing controller can be synchronized. Thus, it is possible to prevent an unnatural black screen from being displayed on the display panel, in response to the case in which an abnormal display signal is inputted.

Furthermore, when the display panel is driven using the plurality of TMICs each having the source driver merged with the timing controller, it is possible to prevent a malfunction in which the data of the respective TMICs are not synchronized with each other due to the frequency deviation between the clock signals generated from the respective oscillators.

Furthermore, it is possible to express the data of the TMICs, which are not synchronize due to the frequency deviation between the clock signals generated from the respective oscillators, using the improved data output enable signal of the gate driver.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A driving control circuit of a display device comprising one data driving circuit operating as a master and one or more data driving circuits operating as a slave, wherein each of the data driving circuits comprises an oscillator configured to provide a clock signal, generates data using the clock signal in response to input of an abnormal display signal, provides the generated data to a display panel, provides a data enable signal to the one or more data driving circuits operating as the slave when set to the master, matches an end time of a horizontal blank interval, in which the data is loaded into a data line of the display panel with the data enable signal when set to the slave, and provides a gate output enable signal to stop the data of the data line from being transmitted to a pixel before a data latch enable signal is supplied.

2. The driving control circuit according to claim 1, wherein each of the data driving circuits comprises:

a source driver configured to generate the data using the clock signal in response to the input of the abnormal display signal, and provide the generated data to the display panel;

an input signal detection unit configured to determine whether the abnormal display signal is inputted, using the clock signal, and provide the determination result; and a timing controller configured to provide the data enable signal to the one or more data driving circuit as the slave when set to the master, match the end time of the horizontal blank interval, in which the data is loaded into the data line of the display panel, with the data enable signal when set to the slave, and provide the gate output enable signal to stop the data of the data line from being transmitted to the pixel before the data latch enable signal is supplied.

3. The driving control circuit according to claim 2, wherein the input signal detection unit determines whether the abnormal display signal is inputted, using one or more of data, a clock signal, a data enable signal, a horizontal synchronization signal, and a vertical synchronization signal, which are inputted from outside, by referring to the clock signal.

4. The driving control circuit according to claim 2, wherein the input signal detection unit provides a data type and a frame frequency for generating the data to the source driver, when it is determined that the abnormal display signal was inputted.

5. The driving control circuit according to claim 2, wherein the timing controller receives a command signal including deviation information related to frequency deviation between the oscillators of the respective data driving circuits, and controls one or more of the data enable signal and the gate output enable signal.

6. The driving control circuit according to claim 5, wherein the timing controller comprises a register control unit having an internal register configured to store the deviation information.

7. The driving control circuit according to claim 5, wherein the timing controller comprises a cascade controller, and the cascade controller controls the master or slave setting, using mode determination information provided as any one of a register value and a pin option signal.

8. The driving control circuit according to claim 7, wherein the timing controller further comprises a synchronization signal generation unit, and the synchronization signal generation unit transmits the data enable signal to the one or more data driving circuits operating as the slave when set to the master, and provides the external data enable signal to match the end time of the horizontal blank interval with the data enable signal when set to the slave.

9. The driving control circuit according to claim 7, wherein the timing controller comprises a timing control unit, and the timing control unit uses the data enable signal provided from the source driver when set to the master, uses the external data enable signal when set to the slave, and controls the end time of the horizontal blank interval according to the data enable signal.

10. The driving control circuit according to claim 7, wherein the timing controller comprises a timing control unit and a signal compensation unit, the timing control unit provides compensation information for preventing image distortion caused by a difference of one horizontal cycle between the master and the salve, by referring the deviation information, and the signal compensation unit provides the gate output enable signal for compensating for the time at which the data is stopped from being transmitted to the pixel, by referring to the compensation information.

11. A driving control circuit of a display device, comprising a data driving circuit operating as a master or slave, wherein the data driving circuit comprises an oscillator configured to provide a clock signal, generates data using the clock signal in response to input of an abnormal display signal, provides the generated data to the display panel, provides a data enable signal to one or more data driving circuits operating as the slave when set to the master, matches an end time of a horizontal blank interval, in which the data is loaded into a data line of the display panel, with the data enable signal when set to the slave, and provides a gate output enable signal to stop the data of the data line from being transmitted to a pixel before a data latch enable signal is supplied.

12. The driving control circuit according to claim 11, wherein each of the data driving circuits comprises:

a source driver configured to generate the data using the clock signal in response to the input of the abnormal display signal, and provide the generated data to the display panel;

an input signal detection unit configured to determine whether the abnormal display signal is inputted, using the clock signal, and provide the determination result; and a timing controller configured to provide the data enable signal to the one or more data driving circuits operating as the slave in response to the determination result when set to the master, match the end time of the horizontal blank interval, in which the data is loaded into the data line of the display panel, with the data enable signal when set to the slave, and provide the gate output enable signal to stop the data of the data line from being transmitted to the pixel before the data latch enable signal is supplied.

13. The driving control circuit according to claim 12, wherein the input signal detection unit determines whether the abnormal display signal is inputted, using one or more of data, a clock signal, a data enable signal, a horizontal synchronization signal, and a vertical synchronization signal, which are inputted from outside, by referring to the clock signal.

14. The driving control circuit according to claim 12, wherein the input signal detection unit provides a data type and a frame frequency for generating the data to the source driver, when it is determined that the abnormal display signal was inputted.

15. The driving control circuit according to claim 12, wherein the timing controller receives a command signal including deviation information related to frequency deviation between the oscillators of the respective data driving circuits, and controls one or more of the data enable signal and the gate output enable signal.

16. The driving control circuit according to claim 15, wherein the timing controller comprises a register control unit having an internal register configured to store the deviation information.

17. The driving control circuit according to claim 15, wherein the timing controller comprises a cascade controller, and the cascade controller controls the master or slave setting using mode determination information provided as any one of a register value and a pin option signal.

18. The driving control circuit according to claim 17, wherein the timing controller further comprises a synchronization signal generation unit, and the synchronization signal generation unit transmits the data enable signal to the one or more data driving circuits operating as the slave when set to the master, and provides the external data enable signal to match the end time of the horizontal blank interval with the data enable signal when set to the slave.

19. The driving control circuit according to claim 17, wherein the timing controller comprises a timing control unit, and the timing control unit uses the data enable signal provided from the source driver when set to the master, uses the external data enable signal when set to the slave, and controls the end time of the horizontal blank interval according to the data enable signal.

20. The driving control circuit according to claim 17, wherein the timing controller comprises a timing control unit and a signal compensation unit, the timing control unit provides compensation information for preventing image distortion caused by a difference of one horizontal cycle between the master and the salve, by referring the deviation information, and the signal compensation unit provides the gate output enable signal for compensating for the time at which the data is stopped from being transmitted to the pixel, by referring to the compensation information.

* * * * *